US008854270B2

(12) United States Patent
Lee et al.

(10) Patent No.: US 8,854,270 B2
(45) Date of Patent: Oct. 7, 2014

(54) HYBRID MULTI-ANTENNA SYSTEM AND WIRELESS COMMUNICATION APPARATUS USING THE SAME

(75) Inventors: Cheng-Tse Lee, Jiaoxi Township, Yilan County (TW); Saou-Wen Su, Keelung (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 378 days.

(21) Appl. No.: 13/038,633

(22) Filed: Mar. 2, 2011

(65) Prior Publication Data

US 2012/0169552 A1 Jul. 5, 2012

(30) Foreign Application Priority Data

Dec. 31, 2010 (CN) ..... 2010 1 0616086

(51) Int. Cl.

*H01Q 21/00* (2006.01)
*H01Q 21/30* (2006.01)
*H01Q 13/10* (2006.01)
*H01Q 9/28* (2006.01)

(52) U.S. Cl.

CPC ..... *H01Q 13/10* (2013.01); *H01Q 21/30* (2013.01); *H01Q 9/285* (2013.01)
USPC ..... 343/727; 343/725

(58) Field of Classification Search

CPC ..... H01Q 22/28; H01Q 22/24; H01Q 22/245; H01Q 13/10; H01Q 13/106; H01Q 1/521; H01Q 1/52; H01Q 1/525; H01Q 1/22; H01Q 1/243; H01Q 1/38; H01Q 1/2258; H01Q 1/2275; H01Q 1/24; H01Q 1/241; H01Q 1/242; H04B 7/10
USPC ..... 343/725, 727, 893
See application file for complete search history.

(56) References Cited

U.S. PATENT DOCUMENTS

| | | | | |
|---|---|---|---|---|
| 4,975,711 | A * | 12/1990 | Lee | 343/702 |
| 5,400,042 | A * | 3/1995 | Tulintseff | 343/727 |
| 6,424,309 | B1 * | 7/2002 | Johnston et al. | 343/767 |
| 6,806,839 | B2 * | 10/2004 | Lo | 343/725 |
| 8,531,337 | B2 * | 9/2013 | Soler Castany et al. | 343/702 |
| 2009/0009408 | A1 * | 1/2009 | Rofougaran | 343/702 |

FOREIGN PATENT DOCUMENTS

| | | |
|---|---|---|
| CN | 1778016 A | 5/2006 |
| CN | 1826708 | 8/2006 |
| JP | 2009-303056 | 12/2009 |

* cited by examiner

*Primary Examiner* — Hoang V Nguyen
*Assistant Examiner* — Patrick Holecek
(74) *Attorney, Agent, or Firm* — Li & Cai Intellectual Property (USA) Office

(57) ABSTRACT

A hybrid multi-antenna system includes a system circuit board, an antenna substrate, at least a dipole antenna, and at least a monopole-slot antenna. The system board has at least a system ground plate, and the system ground plate is served as a reflector of the hybrid multi-antenna system. The antenna substrate and the system ground plate have a first distance therebetween. The dipole antenna having a first signal feed-in source and the monopole-slot antenna having a second signal feed-in source respectively provide a first and second operating band, and they are on a surface of the antenna substrate. The monopole-slot antenna is located nearby the dipole antenna. The monopole-slot antenna and the dipole antenna have a second distance therebetween. The first and second signal feed-in sources are vertical to each other, and have the phase difference of 90°.

18 Claims, 11 Drawing Sheets

HYBRID MULTI-ANTENNA SYSTEM AND WIRELESS COMMUNICATION APPARATUS USING THE SAME

BACKGROUND

1. Technical Field

The present disclosure relates to an antenna, in particular, to a hybrid multi-antenna system and a wireless communication apparatus using the same.

2. Description of Related Art

Now, the communication technology develops rapidly and maturely, and thus people usually use the wireless communication apparatuses to surf the internet and communicate by telephone. Regardless of kinds of wireless communication apparatuses, the wireless communication apparatuses need antennas to receive and transmit the wireless signals at specific frequencies. For example, the indoor and outdoor access points (AP) having antennas are the bridges of the wireless communication apparatuses.

In general, the patch antennas or microstrip antennas have been widely used in outdoor AP due to their characteristics of high directivity and antenna gain.

Some related publications have disclosed the dual-polarized antenna array having a feed-in network and multiple antenna units. The feed-in network of the dual-polarized antenna is used to generate the phase difference of the feed-in signals, such that the dual-polarized radiation pattern can be obtained in the space. Meanwhile, since the multiple antenna units are arranged on the same reflector by the array arrangement, the directivity and gain of the radiation pattern of the dual-polarized antenna can obviously be improved.

However, the aforementioned dual-polarized antenna needs the complex feed-in network and the multiple antenna units to enhance the directivity and antenna gain. In addition, the resonant length of the patch antenna or microstrip antenna is about the half wavelength of the specific frequency. Therefore, owing to its large dimension, the dual-polarized antenna is not suitable for the multiple-input multiple-output (MIMO) multi-antenna communication system.

Regarding each of the multiple antenna units, to decrease the used space of the antenna system, the receiving and transmitting antennas must be arranged compactly. However, due to that the antennas are arranged compactly, the signals received or transmitted by the antennas are mutual coupled when each of the antennas operates in the same or similar band, such that it has the problem of the co-channel interference for the antenna reception. In addition, due to mutual coupling of signals, the system throughput is thus decreased. Taking two parallel dipole antennas as an example, the distance between the two dipole antennas is usually larger than 0.65 wavelength of the operating frequency (i.e. the operating frequency is the specific frequency of the wireless signal), such that the interference of the two dipole antennas is decreased, and the antenna isolation is guaranteed to be less than −15 decibel (dB). However, since the distances between the antennas in the multi-antenna system are limited, the overall dimension of the multi-antenna system is very large, and is unable to be integrated in the thin, light, and small wireless communication apparatus.

Since the strobe feed-in manner is usually used in the patch antenna or microstrip antenna, the location of the feed-in end of the antenna must match the location of the radio signal output end on the system circuit board, and this means that the other antenna is unable to match the same system circuit board.

SUMMARY

An exemplary embodiment of the present disclosure provides a hybrid multi-antenna system comprising a system circuit board, an antenna substrate, at least a dipole antenna, and at least a monopole-slot antenna. The system circuit board has at least a system ground plate located thereon, and the system ground plate is served as a reflector of the hybrid multi-antenna system. The antenna substrate and the system ground plate have a first distance therebetween. The dipole antenna provides a first operating band, and has a first signal feed-in source. The monopole-slot antenna provides a second operating band, and has a second signal feed-in source. The dipole antenna and the monopole-slot antenna are located on a surface of the antenna substrate, and the monopole-slot antenna is located nearby the dipole antenna. The monopole-slot antenna and the dipole antenna have a second distance therebetween. The first and second signal feed-in sources are vertical to each other, and have the phase difference of 90°.

An exemplary embodiment of the present disclosure provides a wireless communication apparatus, wherein a transceiver chip of the wireless communication apparatus is located on the system circuit board, and electrically connected to the hybrid multi-antenna system.

To sum up, the hybrid multi-antenna system provided by an exemplary embodiment of the present disclosure has the simple antenna structure, the small size, and the low cost. Furthermore, the hybrid multi-antenna system is easy to be implemented, integrated and embedded in the wireless communication apparatus.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

DESCRIPTION OF THE EXEMPLARY EMBODIMENTS

[Exemplary Embodiment of Hybrid Multi-Antenna System]

Figure 1:
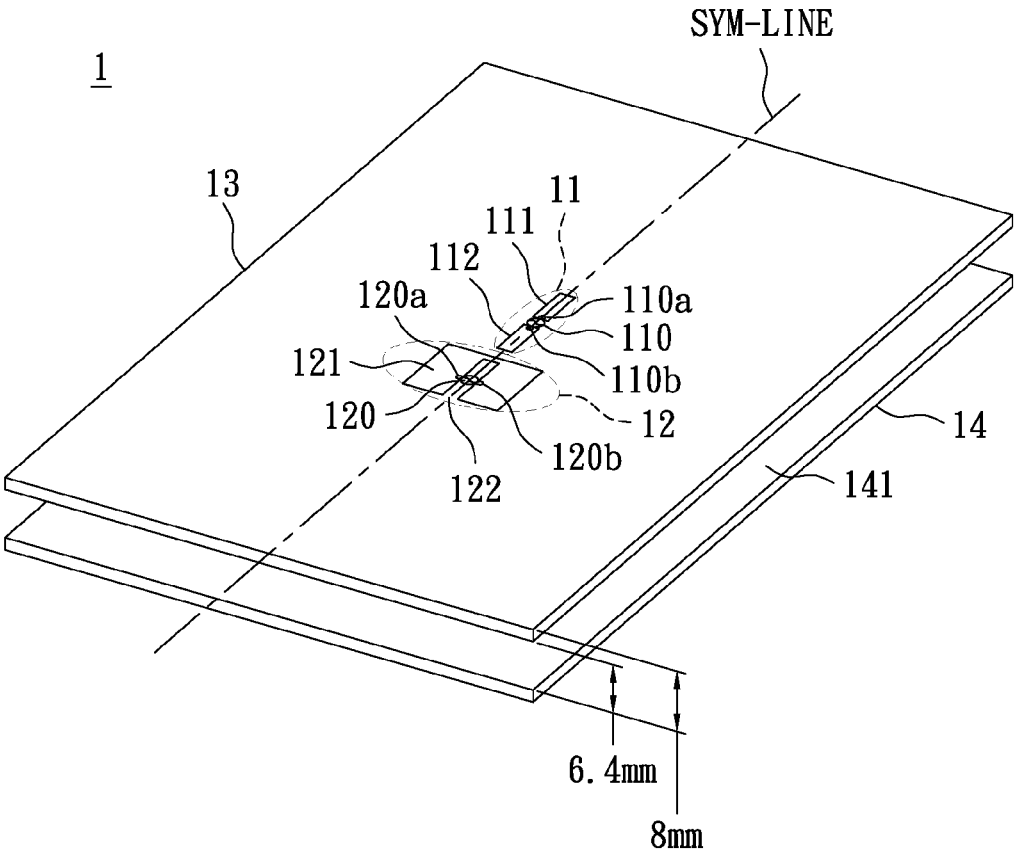
FIG. 1 is a schematic diagram showing a three-dimensional structure of a hybrid multi-antenna system according to an exemplary embodiment of the present disclosure.

Referring to FIG. 1, FIG. 1 is a schematic diagram showing a three-dimensional structure of a hybrid multi-antenna system according to an exemplary embodiment of the present disclosure. The hybrid multi-antenna system 1 comprises a dipole antenna 11, a monopole-slot antenna 12, an antenna substrate 13, and a system circuit board 14. The system circuit board 14 has a system ground plate 141, and the system ground plate 141 is a conductive material. The antenna substrate 13 is located on the system circuit board 14. The system ground plate 141 is served as a reflector of the hybrid multi-antenna system 1. Since the system ground plate 141 is the reflector of the hybrid multi-antenna system, the area of the system ground plate 141 must cover the overall vertical projected area of the dipole antenna 11 and the monopole-slot antenna 12. The dipole antenna 11 and the monopole-slot antenna 12 may be printed on antenna substrate 13.

The antenna substrate 13 of the hybrid multi-antenna system 1 is located on the system circuit board 14 (system ground plate 141) of the wireless communication apparatus, and the system ground plate 141 and the antenna substrate 13 have a distance therebetween. It means that the antenna substrate 13 and the system circuit board 14 are two independent structures. The system ground plate 141 of the system circuit board 14 is served as the reflector of the hybrid multi-antenna system 1, such that the antenna radiation energy is focused on the normal direction of the antenna substrate 13, and the hybrid multi-antenna system 1 thus has the high directivity and the high antenna gain. Accordingly, the wireless signal transmission distance can be improved by using this multi-antenna system 1.

In the exemplary embodiment, the distance between the top surface of the system ground plate 141 and the bottom surface the antenna substrate 13 is 6.4 millimeters. The system ground plate 141 may be a polygonal, circular, or elliptical metal plate, and the top surface of the system ground plate 141 and the bottom surface of the antenna substrate 13 are separated by air. In addition, the system circuit board 14 and the antenna substrate 13 may be the FR4 substrates having the thickness of 1.6 millimeters. Therefore, the distance between the top surface of the system circuit board 14 and the top surface of antenna substrate 13 is 8 millimeters. It is noted that the mentioned distance between each elements, the mentioned material of the substrates, and the mentioned shape and material of the system ground plate 141 are intended to illustrate one exemplary embodiment of the present disclosure, but not to limit the present disclosure.

The dipole antenna 11 provides a first operating band, and has a first signal feed-in source 110. The monopole-slot antenna 12 provides a second operating band, and has a second signal feed-in source 120. The dipole antenna 11 and the monopole-slot antenna 12 are located on the top surface of the antenna substrate 13, and the first signal feed-in source 110 and the second signal feed-in source 120 are vertical to each other, and have a phase difference of 90°. The monopole-slot antenna 12 is located nearby the dipole antenna 11, and the monopole-slot antenna 12 and the dipole antenna 11 have a small distance therebetween.

The dipole antenna 11 further has two radiating units 111 and 112, and the first signal feed-in source 110 has two first signal feed-in points 110*a* and 110*b*, wherein the two first signal feed-in points 110*a* and 110*b* of the first signal feed-in source 110 are respectively located on the two opposite sides of the radiating units 111 and 112. The two ends of first signal feed-in source 110 (i.e. the first signal feed-in points 110*a* and 110*b*) are respectively electrically connected to the radiating units 111 and 112. The radiating units 111 and 112 extend to two opposite directions, and a summation length of the first and second radiating units 111 and 112 is about half wavelength of a central frequency of the first operating band.

The monopole-slot antenna 12 has a second signal feed-in source 120, a radiating conductor sheet 121, and a slot 122, wherein the second signal feed-in source 120 has two second signal feed-in points 120*a* and 120*b*, wherein the second signal feed-in points 120*a* and 120*b* are respectively located on two opposite long sides of the slot 122 (i.e. the first and second long sides mentioned later). The radiating conductor sheet 121 for example is a radiating metal sheet, and the radiating conductor sheet 121 has a firs side (nearby the radiating unit 112 and vertically symmetrical to the symmetric center line SYM_LINE) and a second side, wherein the second side is opposite to the first side. The slot 122 has an open-end, a first long side, and a second long side, wherein the first long side is opposite to the second long side, and the open-end of the slot 122 is located on the second side of the radiating conductor sheet 121. A length of the slot 122 (i.e. the length of the first or second long side) is about 0.25 wavelength of a central frequency of the second operating band. The length of the slot 122 is larger than the width of the open-end of the slot 122. The two ends of the second signal feed-in source (i.e. the second signal feed-in points 120*a* and 120*b*) are respectively electrically connected to the first and second long sides.

In the exemplary embodiment of FIG. 1, to make the first signal feed-in source 110 and the second signal feed-in source 120 be vertical to each other, a connection direction of the first signal feed-in points 120*a* and 120*b* is vertical to a connection direction of the second signal feed-in points 120*a* and 120*b*.

Furthermore, the dipole antenna 11 is an electrical-current excited antenna, and the monopole-slot antenna 12 is a magnetic-current excited antenna. When the first signal feed-in source 110 of the dipole antenna 11 and the second signal feed-in source 120 of the monopole-slot antenna 12 are vertical to each other, and have the phase difference of 90°, the radiating polarizations of the dipole antenna 11 and the monopole-slot antenna 12 in space are orthogonal to each other, such that mutual coupling effect of the two neighboring antennas can be reduced, and the problem of poor isolation due to the small distance between the antennas is also solved. In other words, if the dipole antenna 11 is rotated with the angle of 90° (i.e. the two opposite extension directions are rotated with the angle of 90°), the hybrid multi-antenna system 1 may not have good performance as mentioned above. In this exemplary embodiment, the distance between the dipole antenna 11 and the monopole-slot antenna 12 of the hybrid multi-antenna system 1 may be reduced to 2 millimeters, and the isolation of the hybrid multi-antenna system 1 may be under −20 dB. By contrast, to obtain a better isolation, the two dipole antenna of the conventional multi-antenna system must have a large distance therebetween.

In addition, to obtain better isolation, the relative locations of the dipole antenna 11 and the monopole-slot antenna 12 are arranged as follows. The dipole antenna 11 and the monopole-slot antenna 12 are substantially symmetrical to the symmetric center line SYM_LINE of the antenna substrate 13, and the center points of the dipole antenna 11 and the monopole-slot antenna 12 are substantially arranged on a same axis. However the relative locations of the dipole antenna 11 and the monopole-slot antenna 12 mentioned above are not used to limit the present disclosure.

In other exemplary embodiments, the center points of the dipole antenna 11 and the monopole-slot antenna 12 may be substantially arranged on the same axis, but not substantially symmetrical to the symmetric center line SYM_LINE of the antenna substrate 13. In other exemplary embodiments, the center points of the dipole antenna 11 and monopole-slot antenna 12 may not substantially arranged on the same axis, and may substantially symmetrical to the symmetric center line SYM_LINE of the antenna substrate 13, either.

In short, the arrangement locations of the dipole antenna 11 and the monopole-slot antenna 12 are not limited thereto. When the first signal feed-in source 110 of the dipole antenna 11 and the second signal feed-in source 120 of the monopole-slot antenna 12 are vertical to each other, the hybrid multi-antenna system 1 can obtain good isolation.

Figure 2:
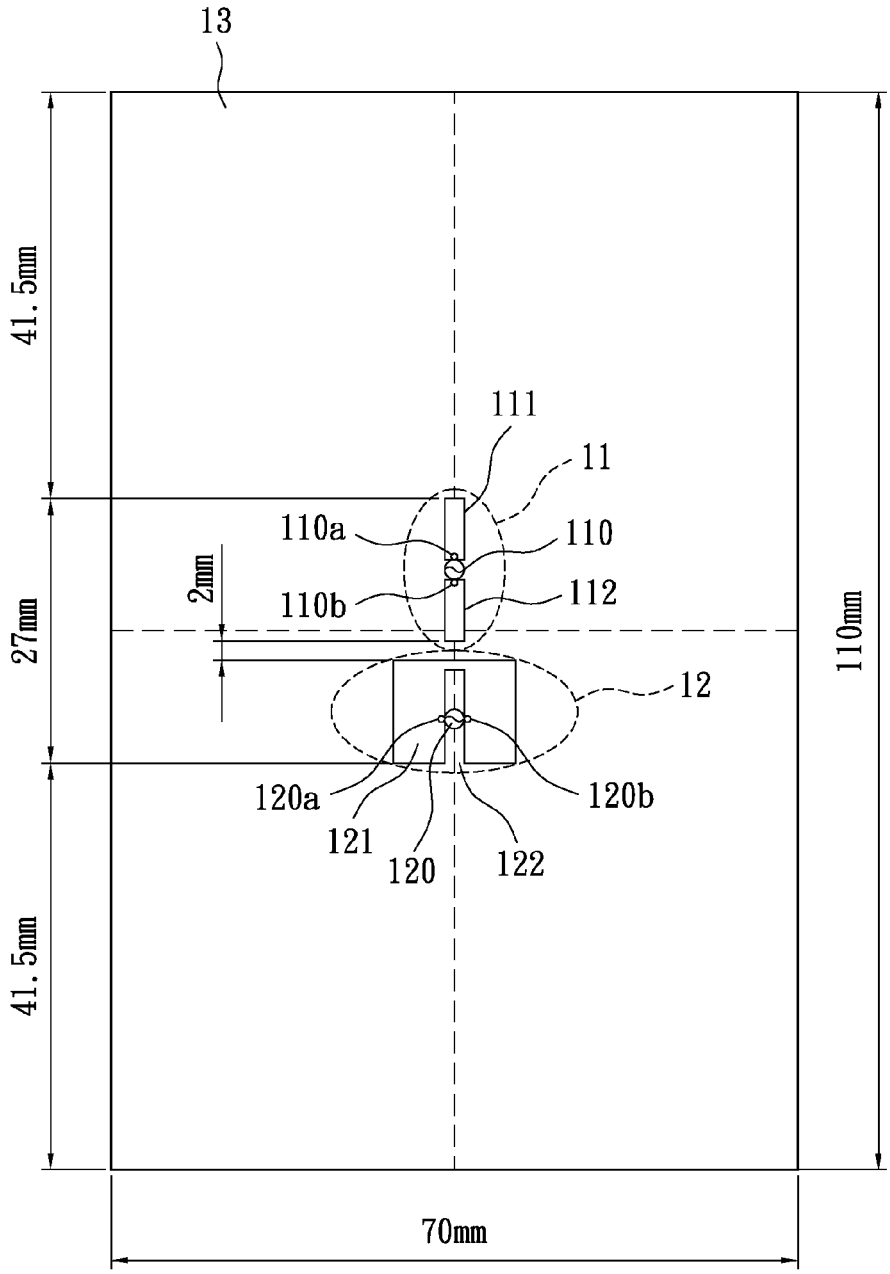
FIG. 2 is a top view diagram of a hybrid multi-antenna system according to an exemplary embodiment of the present disclosure.
Figure 3:
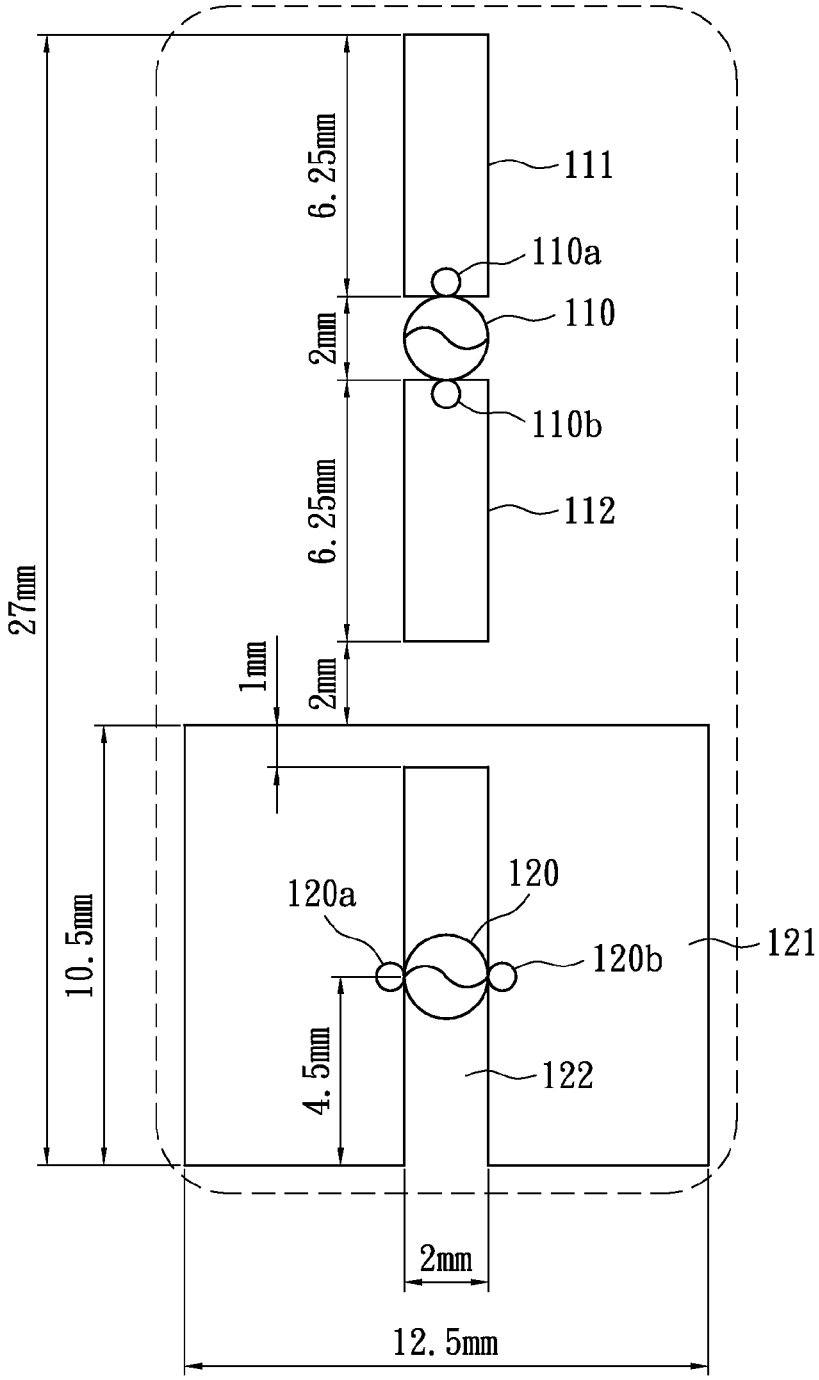
FIG. 3 is a detailed top view diagram of a dipole antenna and a monopole-slot antenna of a hybrid multi-antenna system according to an exemplary embodiment of the present disclosure.

Referring to FIGS. 2 and 3, FIG. 2 is a top view diagram of a hybrid multi-antenna system according to an exemplary embodiment of the present disclosure, and FIG. 3 is a detailed top view diagram of a dipole antenna and a monopole-slot antenna of a hybrid multi-antenna system according to an exemplary embodiment of the present disclosure. In FIG. 2, a length and a width of the antenna substrate 13 are respectively equal to a length and a width of the system circuit board 14, and the length and the width of the antenna substrate 13 are respectively 110 millimeters and 70 millimeters. The summation length of the dipole antenna 11 and the monopole-slot antenna 12 is 27 millimeters, and the dipole antenna 11 and the monopole-slot antenna 12 locate on the center of the antenna substrate 13. In other words, the distance between the second side of the monopole-slot antenna 12 and the bottom side the antenna substrate 13 is 41.5 millimeters, and the distance between the top side of the radiating unit 111 and the top side of the antenna substrate 13 is also 41.5 millimeters.

In FIG. 3, lengths of the radiating units 111 and 112 are 6.25 millimeters, and the distance between the radiating units 111 and 112 is 2 millimeters. The distance between the first side of the monopole-slot antenna 12 and the radiating unit 112 is 2 millimeters, and the width of the open-end of the slot 122 is also 2 millimeters. The width of the radiating conductor sheet 121 is 10.5 millimeters, and the length of the radiating conductor sheet 121 is 12.5 millimeters. The distance between the first side of the monopole-slot antenna 12 and the slot 122 is 1 millimeter. The length of the slot 122 is 9.5 millimeters, and the distance between the central point of the second signal feed-in source 120 and the slot is 4.5 millimeters. The distances, widths, and lengths mentioned in FIGS. 2 and 3 are just used to illustrate one exemplary embodiment, but not used to limit the present disclosure.

Figure 4:
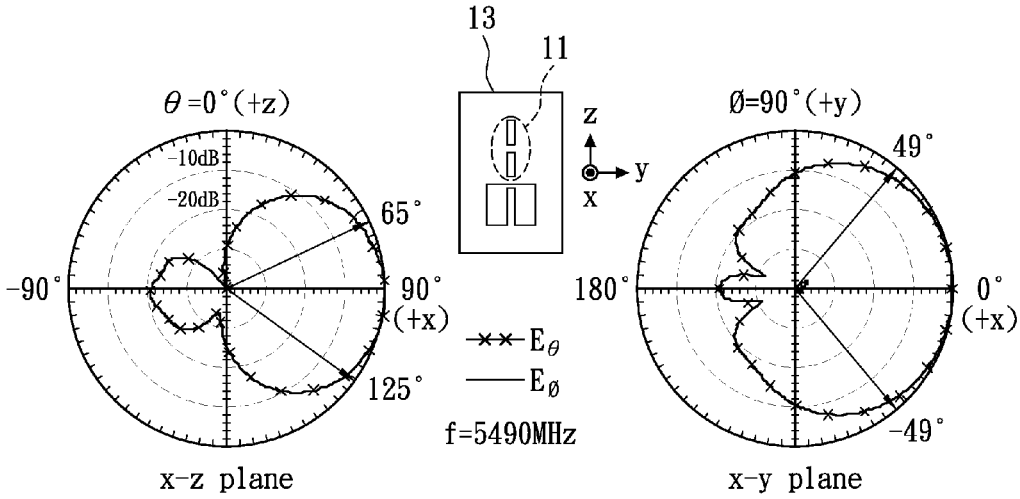
FIG. 4 is a schematic diagram showing a radiation pattern of the dipole antenna in FIG. 1 at a 5490 MHz operating frequency.
Figure 5:
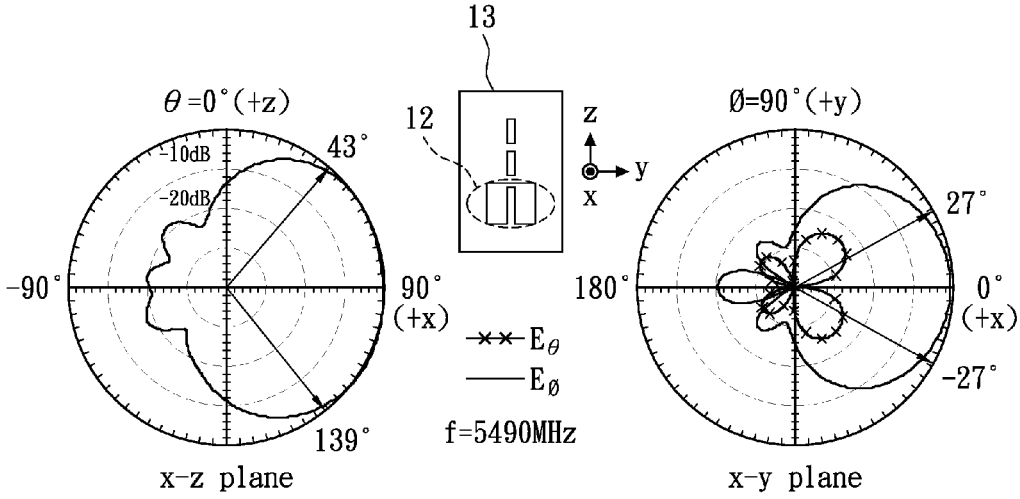
FIG. 5 is a schematic diagram showing a radiation pattern of the monopole-slot antenna in FIG. 1 at a 5490 MHz operating frequency.

Referring to FIGS. 4 and 5, FIG. 4 is a schematic diagram showing a radiation pattern of the dipole antenna in FIG. 1 at a 5490 MHz operating frequency, and FIG. 5 is a schematic diagram showing a radiation pattern of the monopole-slot antenna in FIG. 1 at a 5490 MHz operating frequency. From FIGS. 4 and 5, it is known that the antenna radiation energy of the dipole antenna 11 and the monopole-slot antenna 12 in FIG. 1 is focused on the normal direction (i.e. direction of the x-axis) of the antenna substrate 13. As mentioned above, the radiating polarizations of the dipole antenna 11 and the monopole-slot antenna 12 in space are orthogonal to each other, such that mutual coupling effect of the two neighboring antennas is reduced.

Figure 6:
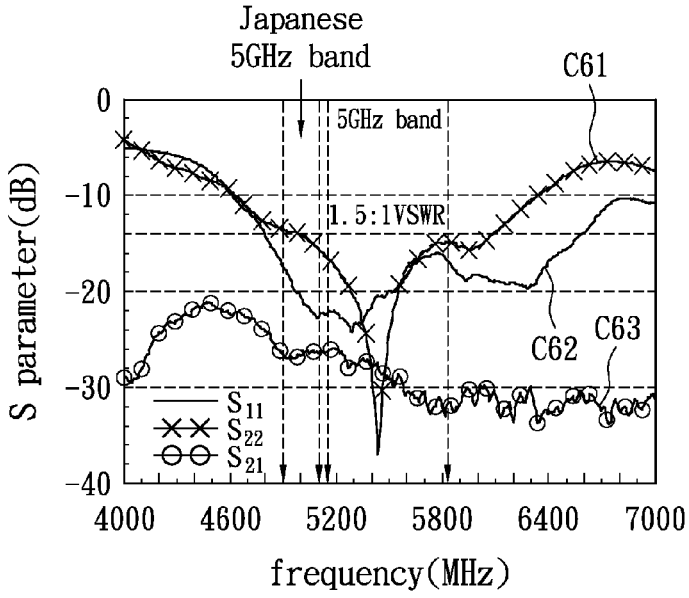
FIG. 6 is a curve diagram showing the S parameters of the hybrid multi-antenna system in FIG. 1 at different operating frequencies.

Referring to FIG. 6, FIG. 6 is a curve diagram showing the S parameters of the hybrid multi-antenna system in FIG. 1 at different operating frequencies. The curves C61 through C63 of the S parameters in FIG. 6 are obtained under the condition that the voltage standing wave ratio (VSWR) is 1.5:1. The curve C61 presents the S parameter $S_{22}$ (ratio of the input signal of the second port and the reflected signal of the second port). The curve C62 presents the S parameter $S_{11}$ (ratio of the input signal of the first port and the reflected signal of the first port). The curve C63 presents the S parameter $S_{21}$ (ratio of the input signal of the first port and the received signal of the second port). From FIG. 6, it is known that the hybrid multi-antenna system 1 in FIG. 1 can be operated in 5 GHz band, and in particular, in 5.15 GHz through 5.825 GHz band.

Figure 7:
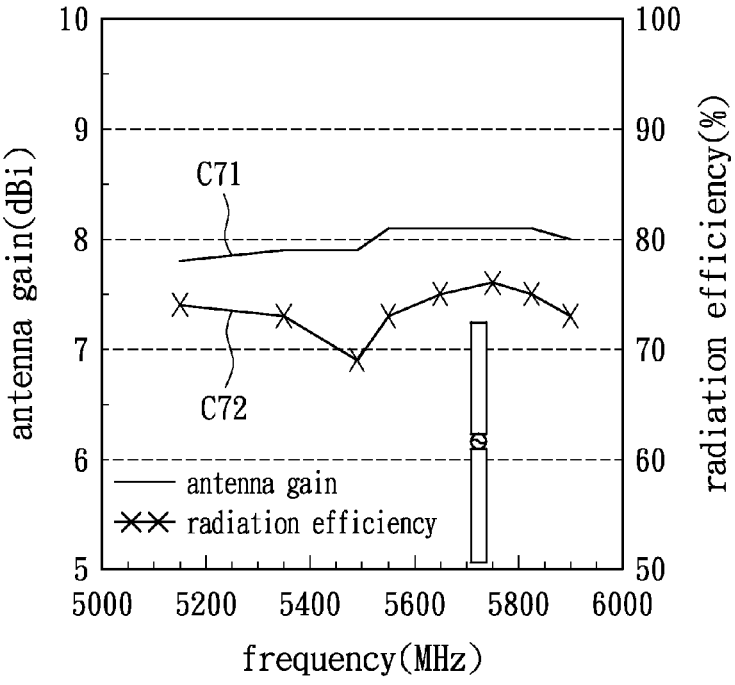
FIG. 7 is a curve diagram showing an antenna gain and a radiation efficiency of the dipole antenna in FIG. 1.
Figure 8:
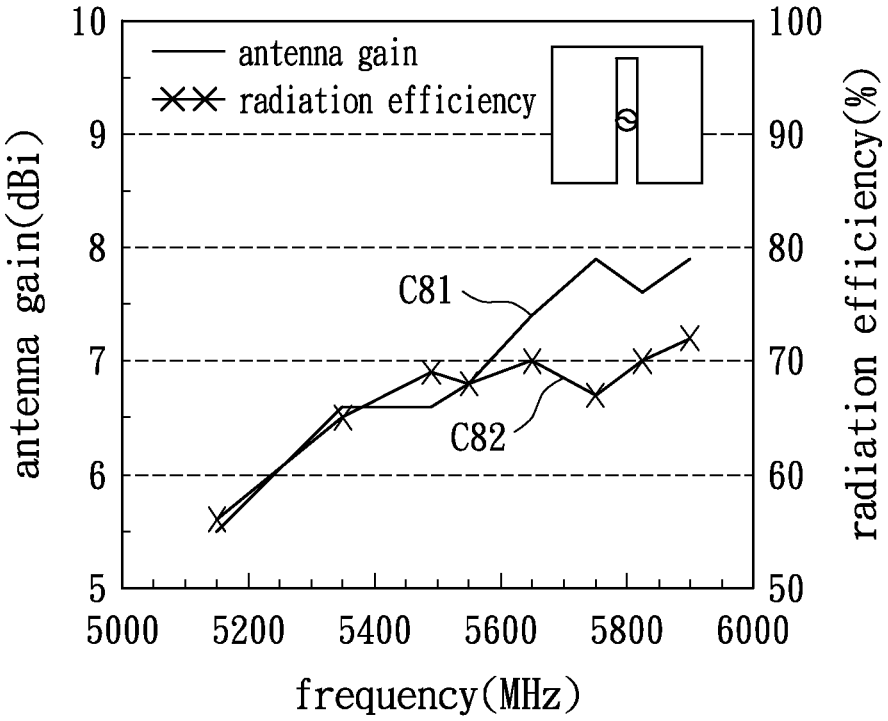
FIG. 8 is a curve diagram showing an antenna gain and a radiation efficiency of the monopole-slot antenna in FIG. 1.

Referring to FIGS. 7 and 8, FIG. 7 is a curve diagram showing an antenna gain and a radiation efficiency of the dipole antenna in FIG. 1, and FIG. 8 is a curve diagram showing an antenna gain and a radiation efficiency of the monopole-slot antenna in FIG. 1. The curves C71 and C81 respectively present the antenna gains corresponding to the central frequencies of the dipole antenna 11 and the monopole-slot antenna 12 in FIG. 1. The curves C71 and C81 respectively present the radiation efficiencies corresponding to the central frequencies of the dipole antenna 11 and the monopole-slot antenna 12 in FIG. 1. From FIGS. 7 and 8, it is known that when the dipole antenna 11 and the monopole-slot antenna 12 are operated in 5 GHz band, their antenna gains can be at least 8 dBi, and their radiation efficiencies can be larger than 60%.

[Other Exemplary Embodiment of Hybrid Multi-Antenna System]

In the above exemplary embodiment, the slot 122 of the monopole-slot antenna 12 is a rectangular slot, and the open-end of the slot 122 of the monopole-slot antenna 12 is located on the second side of the radiating conductor sheet 121. However, it is noted that the slot shape of the monopole-slot antenna 12 and the location of the slot are not used to limit the present disclosure. In the following exemplary embodiments, the first signal feed-in source of dipole antenna and the second signal feed-in source of the monopole-slot antenna are still vertical to each other, and still have a phase difference of 90°.

Figure 9A:
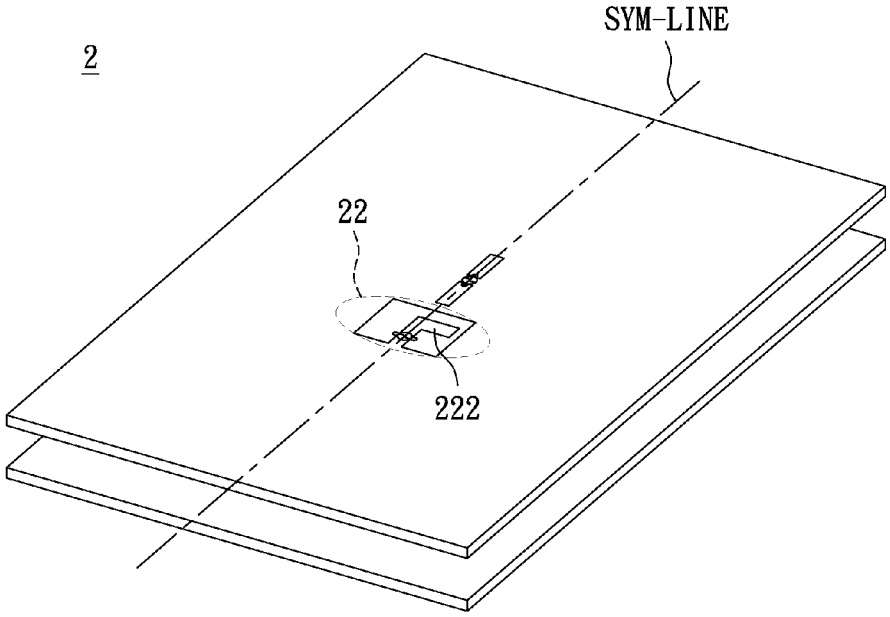
FIGS. 9A through 12 are schematic diagrams showing three-dimensional structures of hybrid multi-antenna systems according to other exemplary embodiments of the present disclosure.
Figure 9B:
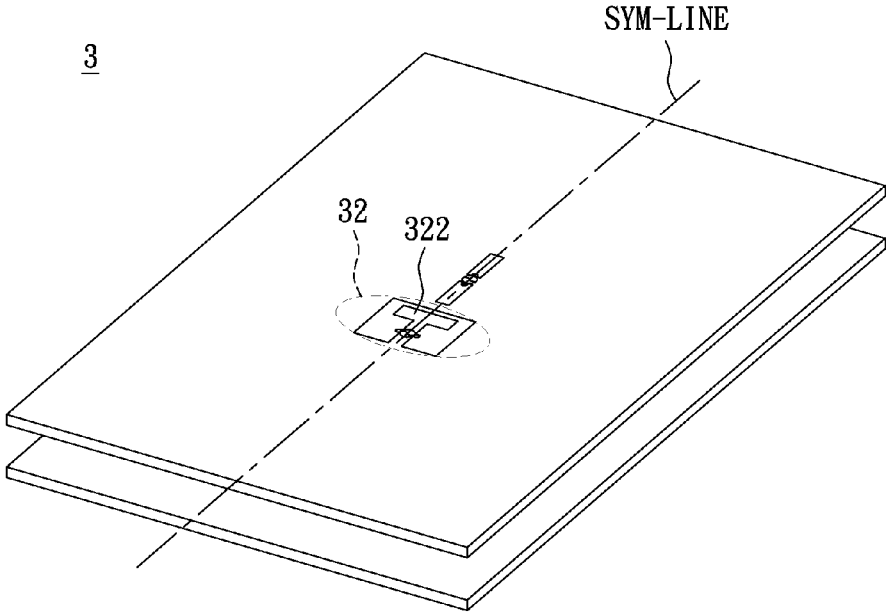
Figure 9C:
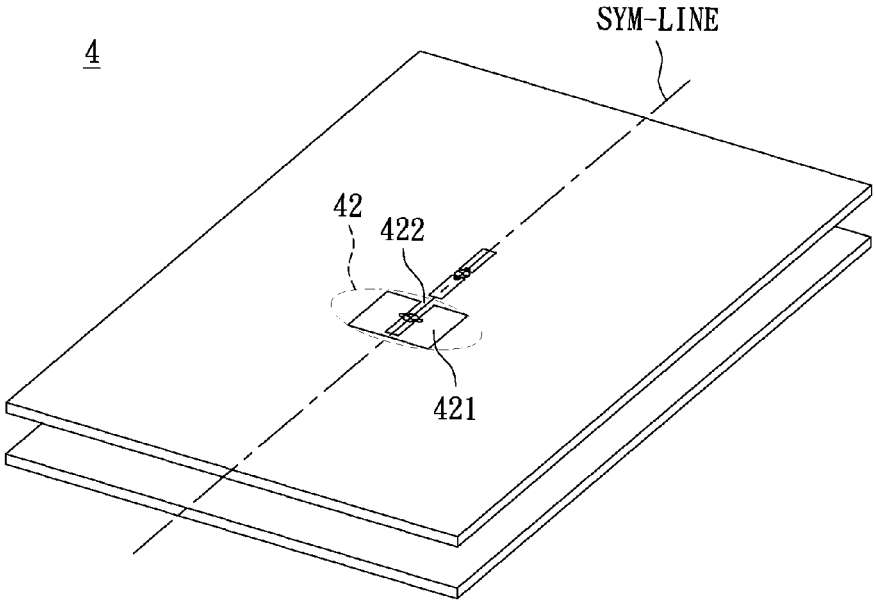

Referring to FIGS. 9A through 9C, FIGS. 9A through 9C are schematic diagrams showing three-dimensional structures of hybrid multi-antenna systems according to other exemplary embodiments of the present disclosure. The slot 222 of the monopole-slot antenna 22 of the hybrid multi-antenna system 2 in FIG. 9A is an L-shaped slot. The slot 322 of the monopole-slot antenna 32 of the hybrid multi-antenna system 3 in FIG. 9B is a T-shaped slot. The slot 422 of the monopole-slot antenna 42 of the hybrid multi-antenna system 4 in FIG. 9C is still a rectangular slot, but the open-end of the slot 422 is located on the first side of the radiating conductor sheet 421.

In the above exemplary embodiment, the radiating units of the dipole antenna are rectangular radiating conductor sheets. However, it is noted that the shape of the radiating units of the dipole antenna are not used to limit the present disclosure, and the shapes of the two radiating units of the dipole antenna may be different from each other. In other words, the radiating units of the dipole antenna may be rectangular, triangular, triangular, elliptic, or hook-shaped radiating conductor sheets. In the following exemplary embodiments, the first signal feed-in source of dipole antenna and the second signal feed-in source of the monopole-slot antenna are still vertical to each other, and still have a phase difference of 90°.

Figure 10A:
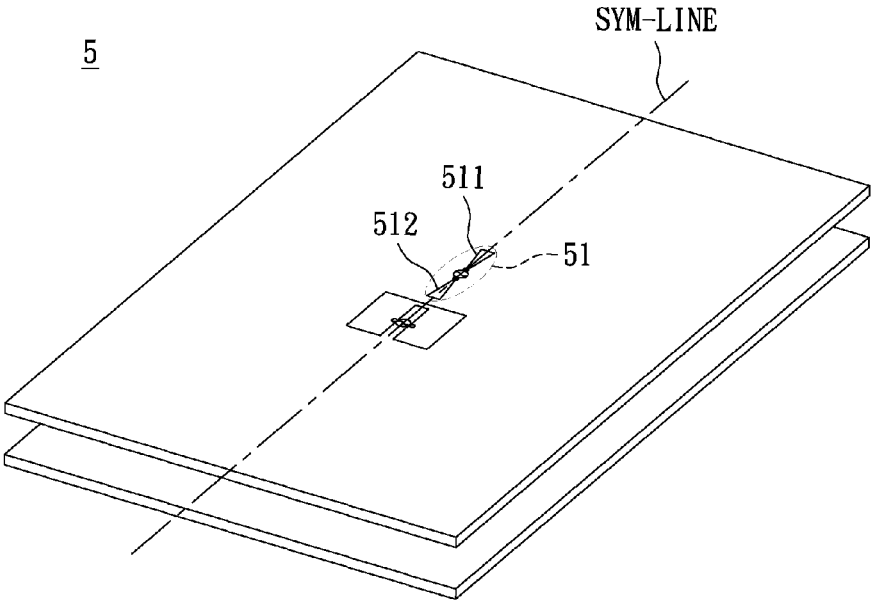
Figure 10B:
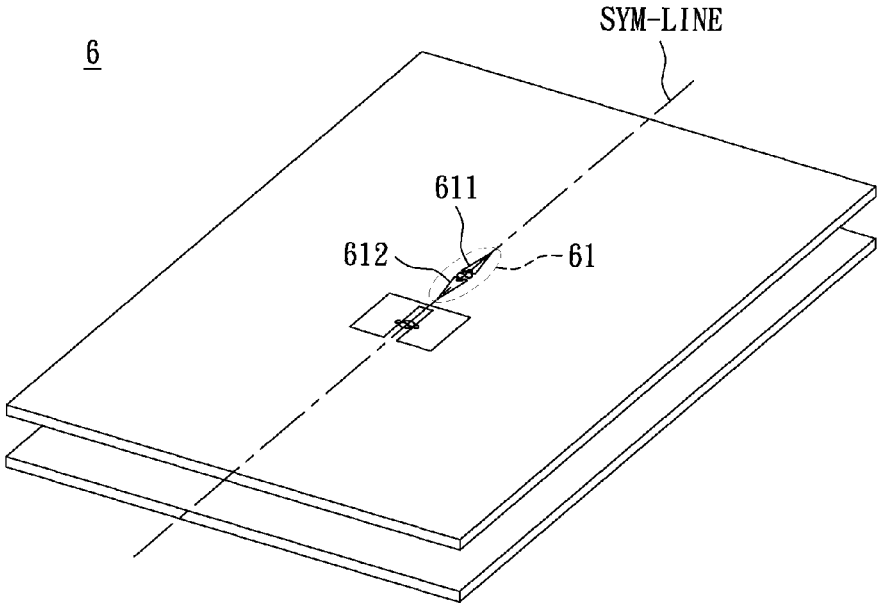
Figure 10C:
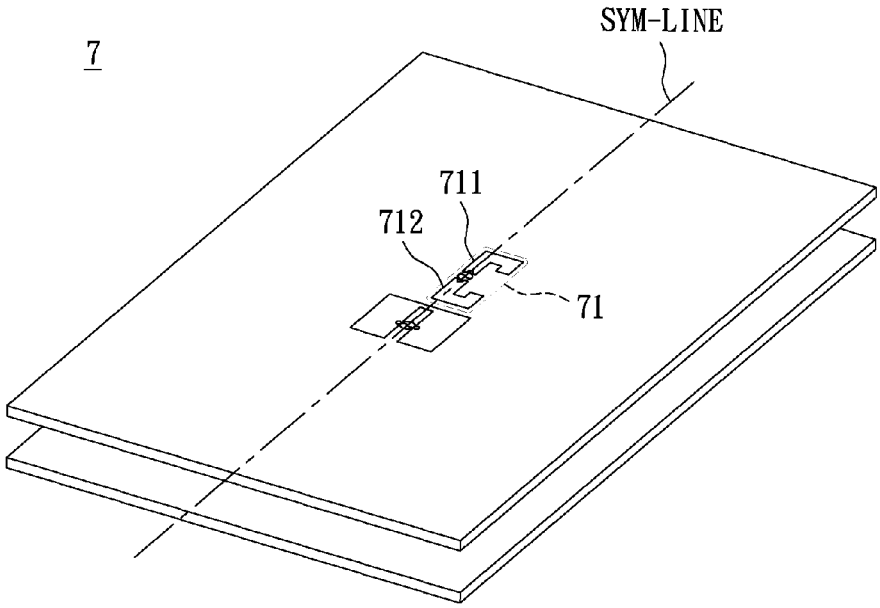

Referring to FIGS. 10A through 10C, FIGS. 10A through 10C are schematic diagrams showing three-dimensional structures of hybrid multi-antenna systems according to other exemplary embodiments of the present disclosure. In FIG. 10A, the radiating units 511 and 512 of the dipole antenna 51 of the hybrid multi-antenna system 5 are triangular radiating units. In FIG. 10B, the radiating units 611 and 612 of the dipole antenna 61 of the hybrid multi-antenna system 6 are still triangular radiating units, but locations of the vertexes of the triangular radiating units in FIGS. 10A and 10B are different from each other. In FIG. 10C, the radiating units 711 and 712 of the dipole antenna 71 of the hybrid multi-antenna system 7 are hook-shaped radiating units.

In the above exemplary embodiment, the center points of the monopole-slot antenna and the dipole antenna are substantially arranged on a same axis, and symmetrical to the symmetric center line. However, as mentioned above, the locations and the arrangements of the monopole-slot antenna and the dipole antenna are not used to limit the present disclosure. In the following exemplary embodiment, the first signal feed-in source of dipole antenna and the second signal feed-in source of the monopole-slot antenna are still vertical to each other, and still have a phase difference of 90°.

Figure 11A:
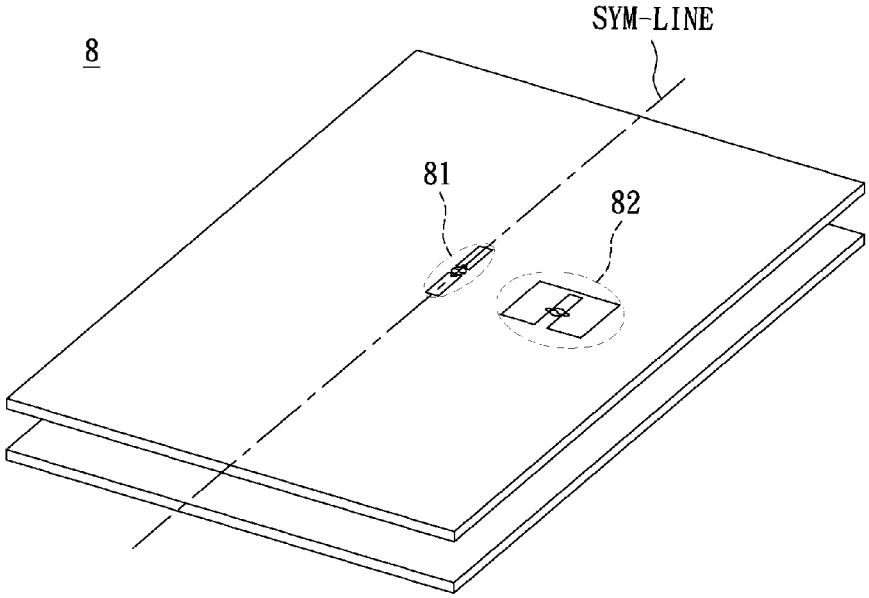
Figure 11B:
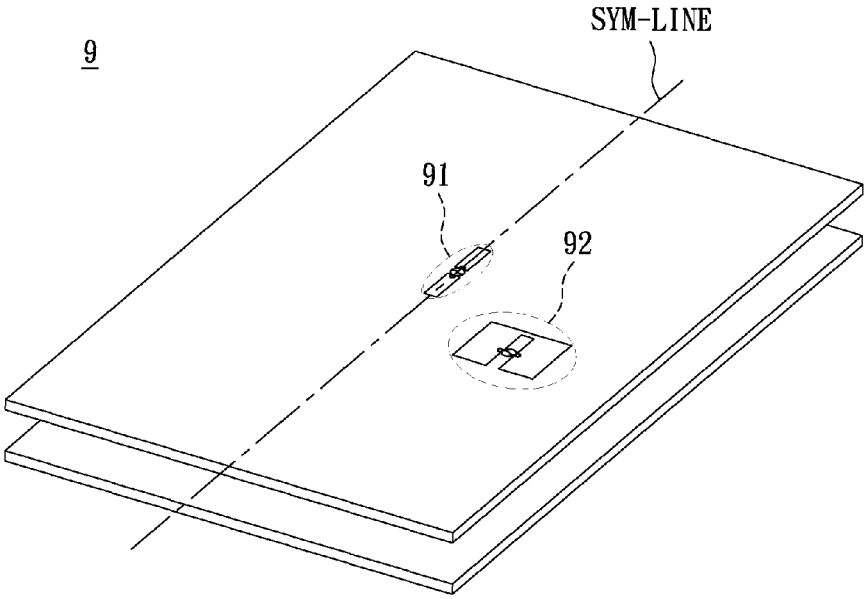

Referring to FIGS. 11A and 11B, FIGS. 11A and 11B are schematic diagrams showing three-dimensional structures of hybrid multi-antenna systems according to other exemplary embodiments of the present disclosure. In FIG. 11A, the center points of the dipole antenna 81 and the monopole-slot antenna 82 of hybrid multi-antenna system 8 are not substantially arranged on a same axis, and not symmetrical to the symmetric center line, either. In the similar manner, the center points of the dipole antenna 91 and the monopole-slot antenna 92 of hybrid multi-antenna system 9 in FIG. 11B are not substantially arranged on a same axis, and not symmetrical to the symmetric center line, either.

In the above exemplary embodiment, the hybrid multi-antenna system comprises one a pair of the dipole antenna and the monopole-slot antenna. However, in the other exemplary embodiments of the present disclosure, the hybrid multi-antenna system may comprise at least one pair of the dipole antenna and the monopole-slot antenna. In the following exemplary embodiment, the first signal feed-in source of dipole antenna and the second signal feed-in source of the monopole-slot antenna are still vertical to each other, and still have a phase difference of 90°.

Figure 12:
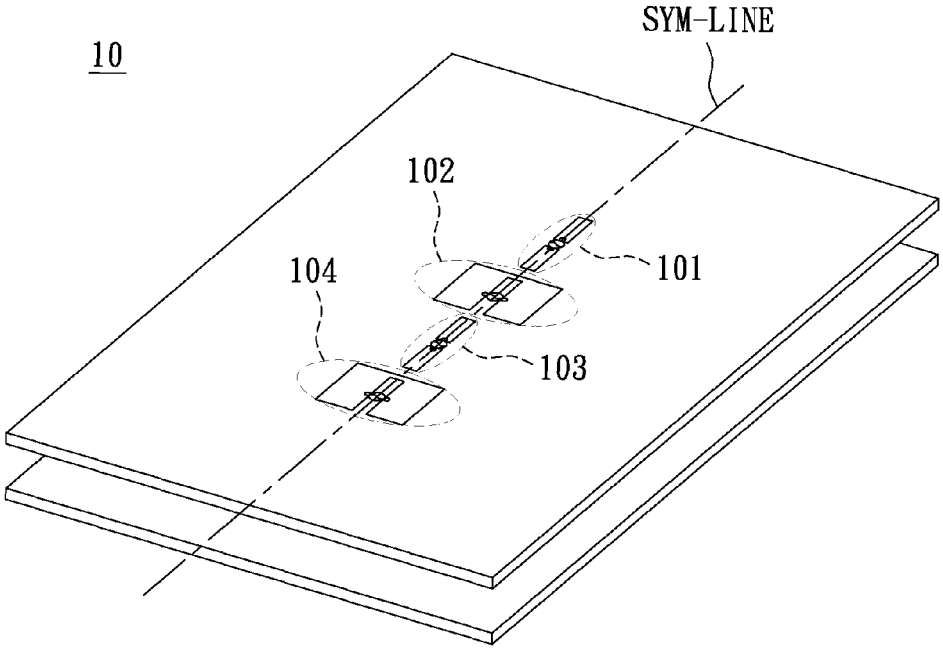

Referring to FIG. 12, FIG. 12 is a schematic diagram showing three-dimensional structure of a hybrid multi-antenna system according to another one exemplary embodiment of the present disclosure. The hybrid multi-antenna system 10 comprises two pairs of the dipole antenna and the monopole-slot antenna. The dipole antennas 101, 103, and the monopole-slot antennas 102, 104, are arranged in an interlaced fashion, the center points of the dipole antennas 101, 103, and the monopole-slot antennas 102, 104 are arranged on a same axis, and the dipole antennas 101, 103, and the monopole-slot antennas 102, 104 are symmetrical to the symmetric center line SYM_LINE.

In short, since the distance between dipole antenna and the monopole-slot antenna and the area of the dipole antenna and the monopole-slot antenna are reduced to be less than those of the convention multi-antenna system, the hybrid multi-antenna system may comprise at least one pair of the dipole antenna and the monopole-slot antenna. Accordingly, to increase the system throughput, the number of the pairs of the dipole antenna and the monopole-slot antenna is increased.

[Exemplary Embodiment of Wireless Communication Apparatus Using Hybrid Multi-Antenna System]

The hybrid multi-antenna system provided by the above exemplary embodiments can be used in the wireless communication apparatus, and the hybrid multi-antenna system can be integrated in the wireless communication apparatus. The transceiver chip of the wireless communication apparatus is located on the system circuit board, and can be electrically connected to the first and second signal feed-in sources of the hybrid multi-antenna system via the mini-coaxial cable. In the above exemplary embodiments, the wireless communication apparatus may be the wireless AP.

[Possible Result of Exemplary Embodiment]

In summary, the hybrid multi-antenna system according to an exemplary embodiment of the present disclosure has the simple antenna structure, the small size, and the low cost. Furthermore, the hybrid multi-antenna system is easy to be implemented, integrated and embedded in the wireless communication apparatus. Moreover, the hybrid multi-antenna system has the high antenna gain and radiation efficiency.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A hybrid multi-antenna system, comprising:

a system circuit board, having at least a system ground plate located thereon, wherein the system ground plate is served as a reflector of the hybrid multi-antenna system;

an antenna substrate, wherein the antenna substrate and the system ground plate have a first distance therebetween;

at least a dipole antenna, providing a first operating band, and comprising a first signal feed-in source; and at least a monopole-slot antenna, providing a second operating band, and comprising:

a second signal feed-in source;

a radiating conductor sheet, having a first side and a second side, wherein the second side is opposite to the first side; and a slot, having an open-end, a first long side, and a second long side, wherein the second long side is opposite to the first long side, the open-end of the slot is located on the first or second side, a length of the slot is about 0.25 wavelength of a central frequency of the second operating band, the second signal feed-in source is disposed on the radiating conductor sheet, one end of the second signal feed-in source is electrically connected to the first long side, and the other end of the second signal feed-in source is electrically connected to the second long side;

wherein the dipole antenna and the monopole-slot antenna are located on a same surface of the antenna substrate, the monopole-slot antenna and the dipole antenna have a second distance therebetween, and the first signal feed-in source and the second signal feed-in source are perpendicular to each other, and have a phase difference of 90°.

2. The hybrid multi-antenna system according to claim 1, wherein the first signal feed-in source has two first signal feed-in points respectively located on two opposite sides of two radiating units of the dipole antenna, and the second signal feed-in source has two second signal feed-in points respectively located on two opposite long sides of the slot of the monopole-slot antenna, wherein a connection direction of the first signal feed-in points is vertical to a connection direction of the second signal feed-in points, whereby radiating polarizations of the dipole antenna and the monopole-slot antenna in space are orthogonal to each other, such that mutual coupling effect of the dipole antenna and the monopole-slot antenna can be reduced, and a problem of poor isolation due to a small distance between the dipole antenna and the monopole-slot antenna is also solved.

3. The hybrid multi-antenna system according to claim 1, wherein the dipole antenna comprises:

a first radiating unit and a second radiating unit, respectively extending to two opposite extension directions, wherein a summation length of the first and second radiating units is about half wavelength of a central frequency of the first operating band, one end of the first signal feed-in source is electrically connected to the first radiating unit, and the other end of the first signal feed-in source is electrically connected to the second radiating unit.

4. The hybrid multi-antenna system according to claim 1, wherein the length of the slot is larger than a width of the open-end of the slot.

5. The hybrid multi-antenna system according to claim 1, wherein center points of the dipole antenna and the monopole-slot antenna are substantially arranged on a same axis.

6. The hybrid multi-antenna system according to claim 1, wherein the antenna substrate further has a symmetric center line, and the dipole antenna and the monopole-slot antenna are substantially symmetrical to the symmetric center line.

7. The hybrid multi-antenna system according to claim 1, wherein the central frequency of the first operating band is about 5 GHz, and the central frequency of the second operating band is also about 5 GHz.

8. The hybrid multi-antenna system according to claim 1, wherein a slot of the monopole-slot antenna is a rectangular, L-shaped, or T-shaped slot, and a first and second radiating units of the dipole antenna are two rectangular, triangular, elliptic, or hook-shaped radiating conductor sheets.

9. The hybrid multi-antenna system according to claim 1, wherein at least the dipole antenna comprises multiple dipole antennas, at least the monopole-slot antenna comprises multiple monopole-slot antennas, the dipole antennas and the monopole-slot antennas are arranged in an interlaced fashion, and center points of the dipole antennas and the monopole-slot antennas are arranged on a same axis.

10. A wireless communication apparatus, comprising:

a transceiver chip, located on a system circuit board, electrically connected to a hybrid multi-antenna system; and the hybrid multi-antenna system, comprising:

the system circuit board, having at least a system ground plate located thereon, wherein the system ground plate is served as a reflector of the hybrid multi-antenna system;

an antenna substrate, wherein the antenna substrate and the system ground plate have a first distance therebetween;

at least a dipole antenna, providing a first operating band, and comprising a first signal feed-in source; and at least a monopole-slot antenna, providing a second operating band, and comprising:

a second signal feed-in source;

a radiation conductor sheet, having a first side and a second side, wherein the second side is opposite to the first side; and a slot, having an open-end, a first long side, and a second long side, wherein the second long side is opposite to the first long side, the open-end of the slot is located on the first or second side, a length of the slot is about 0.25 wavelength of a central frequency of the second operating band, the second signal feed-in source is disposed on the radiating conductor sheet, one end of the second signal feed-in source is electrically connected to the first long side, and the other end of the second signal feed-in source is electrically connected to the second long side;

wherein the dipole antenna and the monopole-slot antenna are located on a same surface of the antenna substrate, the monopole-slot antenna and the dipole antenna have a second distance therebetween, and the first signal feed-in source and the second signal feed-in source are perpendicular to each other, and have a phase difference of 90°.

11. The wireless communication apparatus according to claim 10, wherein the first signal feed-in source has two first signal feed-in points respectively located on two opposite sides of two radiating units of the dipole antenna, and the second signal feed-in source has two second signal feed-in points respectively located on two opposite long sides of the slot of the monopole-slot antenna, wherein a connection direction of the first signal feed-in points is vertical to a connection direction of the second signal feed-in points, whereby radiating polarizations of the dipole antenna and the monopole-slot antenna in space are orthogonal to each other, such that mutual coupling effect of the dipole antenna and the monopole-slot antenna can be reduced, and a problem of poor isolation due to a small distance between the dipole antenna and the monopole-slot antenna is also solved.

12. The wireless communication apparatus according to claim 10, wherein the dipole antenna comprises:

a first radiating unit and a second radiating unit, respectively extending to two opposite extension directions, wherein a summation length of the first and second radiating units is about half wavelength of a central frequency of the first operating band, one end of the first signal feed-in source is electrically connected to the first radiating unit, and the other end of the first signal feed-in source is electrically connected to the second radiating unit.

13. The wireless communication apparatus according to claim 10, wherein the length of the slot is larger than a width of the open-end of the slot.

14. The wireless communication apparatus according to claim 10, wherein center points of the dipole antenna and the monopole-slot antenna are substantially arranged on a same axis.

15. The wireless communication apparatus according to claim 10 wherein the antenna substrate further has a symmetric center line, and the dipole antenna and the monopole-slot antenna are substantially symmetrical to the symmetric center line.

16. The wireless communication apparatus according to claim 10, wherein the central frequency of the first operating band is about 5 GHz, and the central frequency of the second operating band is also about 5 GHz.

17. The wireless communication apparatus according to claim 10, wherein a slot of the monopole-slot antenna is a rectangular, L-shaped, or T-shaped slot, and a first and second radiating units of the dipole antenna are two rectangular, triangular, elliptic, or hook-shaped radiating conductor sheets.

18. The wireless communication apparatus according to claim 10, wherein at least the dipole antenna comprises multiple dipole antennas, at least the monopole-slot antenna comprises multiple monopole-slot antennas, the dipole antennas and the monopole-slot antennas are arranged in an interlaced fashion, and center points of the dipole antennas and the monopole-slot antennas are arranged on a same axis.

* * * * *